United States Patent [19]

Gibson et al.

[11] 4,070,186

[45] Jan. 24, 1978

[54] TRIBO MODIFIED TONER MATERIALS VIA SILYLATION AND ELECTROSTATOGRAPHIC IMAGING PROCESS

[75] Inventors: Harry W. Gibson, Penfield; Franklin D. Saeva, Webster, both of N.Y.

[73] Assignee: Xerox Corporation, Stamford, Conn.

[21] Appl. No.: 500,768

[22] Filed: Aug. 26, 1974

[51] Int. Cl.[2] ..... G03G 9/10

[52] U.S. Cl. ..... 96/1 SD; 252/62.1 P; 427/14; 526/29

[58] Field of Search ..... 117/17.5; 96/1 SD; 252/62.1 P, 62.1 L; 260/37 P, 37 NP, 827; 427/14, 20; 526/29

[56] References Cited

U.S. PATENT DOCUMENTS

| | | | |
|---|---|---|---|
| B 422,399 | 1/1975 | Strella et al. | 117/17.5 |
| 3,427,187 | 2/1969 | Wiggill | 260/827 X |
| 3,467,634 | 9/1969 | Jacknow et al. | 260/827 UX |
| 3,553,133 | 1/1971 | Olson | 252/62.1 P |
| 3,554,946 | 1/1971 | Okuno et al. | 252/62.1 |
| 3,579,451 | 5/1971 | Sciambi | 117/17.5 |
| 3,644,566 | 2/1972 | Kincheloe | 260/827 X |
| 3,681,106 | 8/1972 | Burns et al. | 252/62.1 P |
| 3,681,107 | 8/1972 | Moriconi et al. | 117/117.5 |
| 3,779,926 | 12/1973 | Merck et al. | 252/62.1 |
| 3,793,048 | 2/1974 | Nagashima et al. | 117/17.5 |
| 3,798,167 | 3/1974 | Kukla et al. | 96/1 SD |
| 3,809,554 | 5/1974 | Merrill et al. | 117/17.5 |
| 3,850,663 | 11/1974 | Hagenbach | 252/62.1 |
| 3,856,692 | 12/1974 | Mammino et al. | 252/62.1 |
| 3,926,825 | 12/1975 | Honjo et al. | 252/62.1 |

*Primary Examiner*—Harry J. Gwinnell
*Assistant Examiner*—Stuart D. Frenkel

[57] ABSTRACT

Electrostatographic developer compositions for use in developing electrostatic latent images wherein the triboelectric charging potential of functional polymers employed in the toner materials are controlled through chemical alteration of active hydrogen containing materials by silylation. The controlled variation of the triboelectric behavior of functional polymers by silylation provides a means of attaining optimum triboelectric responses in development systems.

22 Claims, No Drawings

TRIBO MODIFIED TONER MATERIALS VIA SILYLATION AND ELECTROSTATOGRAPHIC IMAGING PROCESS

This invention relates in general to imaging systems and more particularly to improved electrostatographic developer mixtures for use in such systems.

The formation and development of images on the surface of photoconductive materials by electrostatographic means is known. The basic electrostatographic process as taught by C. F. Carlson in U.S. Pat. No. 2,297,691 involves placing a uniform electrostatic charge on a photoconductive insulating layer, exposing the layer to a light and shadow image to dissipate the charge on the areas of the layer exposed to the light, and developing the resultant electrostatic latent image by depositing on the image, a finely-divided electroscopic material referred to in the art as "toner". The toner is attracted to those areas of the layer which retain a charge, thereby forming a toner image corresponding to the electrostatic latent image. This "powder" image may then be transferred, usually electrostatically, to a support surface such as paper. The transferred image may subsequently be permanently affixed to the support surface by heat or other suitable affixing means such as solvent or overcoating treatment may be used instead.

Many methods are known for applying the electroscopic particles to the latent image to be developed. One development method as disclosed by E. N. Wise in U.S. Pat. No. 2,618,582 is known as "cascade" development. In this method, developer material, comprising relatively large carrier particles, having finely-divided toner particles electrostatically clinging to the surface of the carrier particles, is conveyed to, and rolled or cascaded across the surface bearing the electrostatic latent image. The charged portions of the surface have a charge of the same polarity as, but stronger than, the carrier particles. Toner and carrier particles having opposite polarities are selected so that the toner particles electrostatically cling to the carrier particles. In order to develop a negatively charged electrostatic latent image, a toner and carrier combination are selected in which the toner is triboelectrically positive in relation to the carrier. Conversely, to develop a positively charged electrostatic latent image, a toner and carrier combination wherein the toner is triboelectrically negative in relation to the carrier is used. The triboelectric relationship between the toner and carrier depends on the relative positions of the materials in the "triboelectric series". In this series, materials are arranged in ascending order of their ability to take on a positive charge. Each material is positive with respect to any material classified below it in the series; and, negative with respect to any material above it in the series. As the developer mixture cascades or rolls across the image-bearing surface, the toner particles are electrostatically attracted from the carrier to the charged portions of the image-bearing surface, whereas they are not electrostatically attracted to the uncharged or background portions of the image which they contact. The carrier particles and unused toner particles are then recycled. The cascade development process is extremely good for the development of line copy images, and is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this process, a developer material containing toner and magnetic carrier particles is attracted to and is carried by a magnet. The magnetic field causes alignment of the magnetic particles in a brush-like configuration. When this magnetic brush is brought into contact with an electrostatic latent image-bearing surface, the toner particles are attracted from the carrier particles of the brush to the charged areas of the image-bearing surface but not to the uncharged areas. Since the charged areas have an imagewise configuration, the toner material clings to the surface in imagewise configuration, thus developing the latent image.

Another method for developing electrostatic latent images is disclosed in U.S. Pat. No. 3,503,776 issued to R. W. Gundlach. In this method, images are formed by transporting an electrostatic latent image-bearing surface in a generally ascending arcuate path, and contracting only the image in a contact zone with a bath of developer material transported in a concave chamber adjacent to the lower path of the imaging surface. The contact zone extends from about the lower-most point of the arcuate path to the uppermost point of the arcuate path. As the imaging surface is transported along its arcuate path, frictional contact between the developer and the imaging surface in the contact zone circulates the developer in the bath and brings developer material into developing configuration with the imaged surface.

Many other methods, such as the "touchdown" development method disclosed by C. R. Mayo in U.S. Pat. No. 2,895,847, are known for applying electroscopic particles to the electrostatic latent image to be developed. The development process, as described above, together with numerous modifications, are well-known to the art through various patents and publications and through the widespread availability and utilization of electrostatographic imaging equipment.

In automatic reproduction equipment, it is conventional to employ as the imaging plate, a photoconductor on a conductive substrate in the form of a cylindrical drum or a flexible belt which is continuously rotated through a cycle of sequential operations including charging, exposing, developing, transferring and cleaning. The developer chamber is charged with a developer mixture comprising carrier particles and enough toner particles for hundreds of reproduction cycles. Generally, the freshly charged developer mixtures contain between about 1.5 and about 5% toner particles based upon the weight of the developer. This initial concentration provides sufficient toner for many reproduction cycles without causing undesirably high background toner deposition.

While ordinarily capable of producing good quality images, conventional developing systems suffer serious deficiencies in certain areas. In the reproduction of high contrast copies such as letters, tracings, and the like, it is desirable to select the electroscopic powder and carrier materials so that their mutual electrification is relatively large; the degree of such electrification being governed in most cases by their relative positions in the triboelectric series. However, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the carrier particles. Although the image density described in the immediately preceding sentence may be improved by increasing the toner concentration in the developer mixture, undesirably high background toner deposition as well as increased toner impaction and agglomeration is encountered when the developer mixture is overtoned. The initial electrostatogrphic plate charge may be increased to improve the density of the deposited powder image, but the plate charge would ordinarily have to be excessively high in order to attract the electroscopic powder away from the carrier particle. Excessively high electrostatographic plate charges are not only undesirable because of the high power consumption necessary to maintain the electrostatographic plate at high potentials, but also because the high potential causes the carrier particles to adhere to the electrostatographic plate surfaces rather than merely roll across and off the electrostatographic plate surface. Print deletion and massive carry-over of carrier particles often occur when carrier particles adhere to reusable electrostatographic imaging surfaces. Massive carrier carry-over problems are particularly acute when the developer is employed in solid area coverage machines where excessive quantities of toner particles are removed from carrier particles thereby leaving many carrier particles substantially bare of toner particles. Further, adherence of carrier particles to reusable electrostatographic imaging surfaces promotes the formation of undesirable scratches on the surface during image transfer and surface cleaning operations.

Thus, it is apparent from the description presented above as well as in other development techniques, that the toner is subjected to severe mechanical attrition which tends to break down the particles into undesirable dust fines. The formation of fines is retarded when the toner contains a tough, high molecular weight resin which is capable of withstanding the shear and impact forces imparted to the toner in the machine. Unfortunately, many high molecular weight materials cannot be employed in high speed automatic machines because they cannot be rapidly fused during a powder image heat fixing step. On the other hand, low molecular weight resins which are easily heat fused at relatively low temperatures are usually undesirable because these materials tend to form thick films on reusable photoconductor surfaces. These films tend to cause image degradation and contribute to machine maintenance down time. Many low molecular weight resins decompose when subjected to fusing conditions in high speed copying and duplicating machines. In addition, low molecular weight resins tend to form tacky images on the copy sheet which are easily smudged and often offset to other adjacent sheets. Additionally, low molecular weight resins are often extremely difficult or even impossible to comminute in conventional grinding apparatus. Also, the toner materials must be capable of accepting a charge of the correct polarity when brought into rubbing contact with the surface of carrier materials in cascade or touchdown development systems. Additionally, many toner materials cannot satisfactorily be transferred by conventional electrostatographic development systems from reusable imaging surfaces in automatic copying and duplicating machines. Since most polymeric toner materials are deficient in one or more of the above areas, there is a continuing need for improved toners and developers.

It is, therefore, an object of the invention to provide toner compositions overcoming the above-noted deficiencies.

It is another object of this invention to provide a method for controllably altering the triboelectric values of toner materials without markedly changing the physical and chemical properties of the original polymer material.

It is a further object of this invention to provide toner material manufacturing techniques for producing developer materials having finely-adjusted triboelectric properites.

It is a further object of this invention to render suitable as toner materials many polymeric materials which were heretofore unsuitable as toner materials.

It is another object of this invention to provide developer materials having triboelectric properties which are superior to known toner and developer materials.

The foregoing objects and others are accomplished generally speaking, by the controlled chemical alteration of the triboelectric charging potential of functional polymers employed as toner materials. The controlled variation of the triboelectric behavior of functional polymers provides a means of attaining optimum triboelectric responses of electrostatographic developer materials for specifically defined applications. Thus, in accordance with this invention, monomeric and/or polymeric materials are systematically chemically modified to provide structural effects which yield structure-triboelectric property relationships among active hydrogen containing materials such as alcohols, acids, amines, amides, imines and their silylation products. These relationships have been found to be extremely helpful in designing new toners. By this invention, the triboelectric charging properties of toner-carrier pairs are controlled to enable optimum triboelectric relationships in developer compositions.

It is to be noted that, by itself, no material has a triboelectric charge. The magnitude of a triboelectric charge depends upon both the toner and the carrier combination. Thus, replacement of one of the components to optimize triboelectric charging properties is generally necessary to provide the desired triboelectric response. By so doing, greater latitude is available for specific electrostatographic applications. In accordance with this invention, it has been found that by varying the degree of chemical modification of polymeric materials for use as toner particles, either stoichiometrically or kinetically, the triboelectric properties of developer materials can be controlled in a continuous manner.

In electrostatographic development of selenium photoconductor latent images, polymers which tend to take on a relatively high negative charge are generally satisfactory for use as toner materials; in electrostatographic development of other photoconductor latent images, for example, zinc oxide, phthalocyanine, cadmium sulfide, polyvinylcarbazole-trinitroflurenone, polymers which tend to acquire relatively high positive charges are generally satisfactory for use as toner materials. In accordance with this invention, the triboelectric properties of developer materials are correlated with their structural composition and thereby predictably controlled. Since the distance between a given toner-carrier pair on a triboelectric charging scale determines the triboelectric charge between them, their relative positions determine the sign of the triboelectric charge. Those materials low on the scale prefer to adopt a positive charge and those materials high on the scale prefer to adopt a negative charge. Appropriate toner-carrier pairs can be selected based on their triboelectric charging or triboelectric series relationship to satisfy a particular acceptable triboelectric charging range requirement for a given electrostatographic machine developer housing.

It has been found that triboelectric behavior is a function of molecular structure which now allows the controlled and progressive modification of the triboelectric charging properties of toner compositions so as to obtain optimum triboelectric charging properties between toner and carrier pairs. Thus, by this invention, adjustment of the triboelectric charging properties of electrostatographic developer materials need not be done in stepwise fashion but may be accomplished in a continuous manner providing a high degree of "fine tuning" of triboelectric properties for developer materials.

In accordance with this invention, the triboelectric charging properties of monomeric and polymeric compounds may be modified by systematic chemical modification by means of silylation. This chemical process leads to changes in the triboelectric behavior of active hydrogen containing materials. The process also allows for controlled variation of triboelectric behavior of toner materials in a continuous fashion. Thus, silylation of hydroxyl moieties of polymeric materials is a means of obtaining such effect. Generally speaking, the passing of a silylating reagent in a stream of inert gas through a solid bed of hydroxylic material accomplishes silylation. The depth or amount of silylation will depend, to some extent, on the permeability of the silylation reagent through solid. For some toner material applications, surface reaction may be sufficient. In addition, solution silylation of the solid may be practiced. Silylation reactions in solution will generally lead to more homogeneous reaction which may be advantageous for some toner applications. In either case, the degree of silylation may be controlled either stoichiometrically or kinetically, making available a continuous range of toner materials having controlled various triboelectric properies. Further, this invention is not limited to the silylation of hydroxyl moieties of polymer materials, but extends as well to the silylation of other active hydrogen containing compounds such as alcohols, carboxylic acids, phenols, mercaptans, amines amides, imines, selenols, thiophenols, and the like. Thus, this invention provides a means of effecting monitored silicon additions to polymeric materials by the addition of organic silicon moieties to effect desired and controlled triboelectric properties thereto. The silicon units may be introduced either as terminal groups or as block copolymer components. Therefore, this method affords a means for systematically varying the triboelectric charging relationship of toner-carrier developer compositions by either surface treatment of the materials or by chemical modification of toner materials prior to their fabrication to provide controlled triboelectric behavior of such materials.

It has been further found that for aliphatic hydroxyls, silylation causes the material to accept more negative tribo-electric charge. Thus, for a toner material candidate, the desired negative triboelectric charge will be improved. Some of the advantages here include the facile reaction of solid hydroxylic substrates with gaseous silylation reagents which occurs readily. In addition, the conversion of hydroxyl moieties to silyl ether moieties may be controlled in a continuous fashion thus allowing the "fine-tuning" of triboelectric properites of developer compositions. For materials containing aromatic hydroxyls, silylation causes the material to accept more positive, that is, less negative, charge in triboelectric charging. Thus, silylation will decrease the negative charge on toners of such structure. Thus, the invention may be employed to increase or decrease the net triboelectric charge to the requisitie level for toner-carrier pairs.

In general, any method such as for preparing silyl ethers is within the scope of this invention. Any suitable silylating agent may be employed to obtain the functionalized toner materials of this invention. Typical silylating agents include dimethylaminotrimethylsilane, trimethyl- and dimethylchlorosilanes and polysiloxanes with reactive terminal moieties.

Further, the use of difunctional silylating agents may lead to crosslinking which in some applications would be advantageous.

The chemical modification of such materials enables the alteration of materials having optimum physical properties in such a way as to improve their triboelectric properties for electrostatographic use. This invention may serve as a guide for the preparation of toner compositions having "finely-tuned" triboelectric charging properties, and the capacity for continuous control of such properites through variation in extent of reaction may be employed for such purpose.

Any suitable vinyl resin having a melting point of at least about 110° F may be employed in the toners of this invention. Generally, suitable vinyl resins employed in the toner have a weight average molecular weight between about 3,000 to about 500,000. The resins may be formed by the polymerization of mixtures of two or more of these unsaturated monomers. The expression "addition polymerization" is intended to include known polymerization techniques such as free radical, anionic and cationic polymerization processes.

The combination of the resin component and colorant whether the resin component is a homopolymer, copolymer, or blend, should have a blocking temperature of at least about 110° F and a melt viscosity of less than about $2.5 \times 10^{-4}$ poise at temperatures up to about 450° F. When the toner is characterized by a blocking temperature less than about 110° F, the toner particles tend to agglomerate during storage and machine operation and also form undesirable films on the surface of reusable photoreceptors which adversely affect image quality.

Any suitable pigment or dye may be employed as the colorant for the toner particles. Toner colorants are well-known and include, for example, carbon black, nigrosine dye, aniline blue, Calco Oil Blue, chrome yellow, ultra marine blue, duPont Oil Red, Quinoline Yellow, methylene blue chloride, phthalocyanine blue, Malachite Green Oxalate, lamp black, Rose Bengal and mixtures thereof. The pigment or dye should be present in the toner in a sufficient quantity to render it highly colored so that it will form a clearly visible image on a recording member. Thus, for example, where conventional electrostatographic copies of typed documents are desired, the toner may comprise black pigment such as carbon black or a black dye such as Amaplast Black dye, available from the National Aniline Products, Inc. Generally, the pigment is employed in an amount from about 1 percent to about 20 percent to about 20 percent by weight based on the total weight of the colored toner. If the toner colorant employed is a dye, substantially smaller quantities of colorant may be used. However, since a number of the above pigments used in electrostatographic toner compositions may affect both the glass transition and fusion temperatures of the toner compositions of this invention, their concentration preferably should not exceed about 10 percent by weight of the colored toner.

The toner compositions of the present invention may be prepared by any well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin, and a solvent.

When the toner materials of this invention are to be employed in a cascade development process, the toner should have an average particle size less than about 30 microns and preferably between about 4 and about 20 microns for optimum results. For use in powder cloud development methods, particle diameters of slightly less than 1 micron are preferred.

Suitable coated and uncoated carrier materials for cascade development are well-known in the art. The carrier particles comprise any suitable materials, provided that the carrier particles acquire a charge having an opposite polarity to that of the toner particles when brought in close contact with the toner particles so that the toner particles adhere to and surround the carrier particles. When a positive reproduction of the electrostatic images is desired, the carrier particle is selected so that the toner particles acquire a charge having a polarity opposite to that of the electrostatic image. Alternatively, if a reversal reproduction of the electrostatic image is desired, the carrier is selected so that the toner particles acquire a charge having the same polarity as that of the electrostatic image. Thus the materials for the carrier particles are selected in accordance with their triboelectric properites in respect to the electroscopic toner so that when mixed or brought into mutual contact, one component of the developer is charged positively if the other component is below the first component in the triboelectric series and negatively if the other component is above the first component in a triboelectric series. By proper selection of carrier materials in accordance with their triboelectric effects, the polarities of their charge, when mixed, are such that the electroscopic toner particles adhere to and are coated on the surfaces of carrier particles and also adhere to that portion of the electrostatic image-bearing surface having a greater attraction for the toner than the carrier particles. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass, silicon dioxide, nickel, steel, iron, ferrites, and the like. The carriers may be employed with or without a coating. Many of the foregoing and other typical carriers are described by L. E. Walkup et al in U.S. Pat. No. 2,638,416 and E. N. Wise in U.S. Pat. No. 2,618,552. An ultimate coated carrier particle diameter between about 50 microns to about 1,000 microns is preferred because the carrier particles then possess sufficient density and inertia to avoid adherence to the electrostatic images during the cascade developement process. Adherence of carrier beads to electrostatographic drums is undesirable because of the formation of deep scratches on the surface during the imaging transfer and drum cleaning steps, particularly where cleaning is accomplished by a web cleaner such as the web disclosed by W. P. Graff, Jr., et al in U.S. Pat. No. 3,186,838. Also print deletion occurs when carrier beads adhere to electrostatographic imaging surfaces. Generally speaking, satisfactory results are obtained when about 1 part toner is used with about 10 to 200 parts by weight of carrier.

The toner compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,903,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

DESCRIPTION OF PREFERRED EMBODIMENTS

The following examples further define, describe, and compare methods of preparing the toner materials of the present invention and of utilizing them to develop electrostatic latent images. Parts and percentages are by weight unless otherwise indicated.

In the following, the relative triboelectric values generated by contact of carrier beads with toner particles is measured by means of a cascade device. The device comprises a grounded metal plate set at an arbitrary but constant angle of elevation to horizontal, for example, 30°, and a cup at the bottom of the incline. The cup is not attached to the incline and is thus not grounded; it is attached to an electrometer. The material to be tested is coated onto a metallic sheet, such as aluminum, and this is attached to the incline. Then beads of the desired carrier material are cascaded down the film and into the electrometer cup, where the charge acquired by the beads is measured. From this quantity and the weight of the beads the charge to mass ratio is calculated. This quantity is a direct measure of the triboelectric charging capacity of the polymeric film. The measurement is done at constant relative humidity and temperature. Since triboelectric measurements are relative, the measurements should, for comparative purposes, be conducted under substantially identical conditions.

EXAMPLE I

About 82.3 grams of carrier beads having a particle size of about 600 microns comprising flintshot coated with ethyl cellulose were dried in vacuo for about 17 hours. In a cascade triboelectric measurement as discussed above, these beads were found to acquire a net charge of about +0.57 nanocoulombs per gram versus a film of a styrene-n-butyl methacrylate copolymer having a 2.54:1.00 mole ratio respectively.

EXAMPLE II

About 10.0 ml of dimethylaminetrimethylsilane was passed on a stream of dry nitrogen through about 82.3 grams of carrier beads having a particle size of about 600 microns comprising flintshot coated with ethyl cellulose disposed in a 1 × 6 inch cylindrical bed over a period of about 25 minutes. After drying in vacuo for about 17 hours, in a cascade triboelectric measurement under substantially the same conditions as in Example I, the treated carrier beads were found to acquire a net charge of about +0.14 nano-coulombs per gram versus a film of a styrene-n-butyl methacrylate copolymer having a 2.54: 1.00 mole ratio as in Example I. Thus, it was found that the triboelectric charging capacity of the silylated carrier beads is more negative after silylation thereof.

EXAMPLE III

About 5.0 ml. of dimethylaminotrimethylsilane was passed on a stream of dry nitrogen through about 60.0 grams of carrier beads having a particle size of about 250 microns coated with the aminolyzed polymer of a styrene-n-butyl methacrylate copolymer containing hydroxyl moieties for about 90 minutes. The aminolyzed polymer was prepared by ester group aminolysis of the styrene-n-butyl methacrylate copolymer having a 2.54:1.00 mole ratio with an aminoalcohol resulting in formation of hydroxyalkyl amide functions. Thus a mixture of about 117.5 grams (0.289 mole of ester functions based on elemental analysis) of the styrene-n-butyl methacrylate, about 41.0 grams (0.350 mole) of 6-aminohexanol, and about 39.3 grams (0.350 mole) of 1,4-diazabicyclo (2,2,2) octane was stirred under dry nitrogen at about 180° C (oil bath temperature 205° C) using an ambient air-cooled condenser to allow escape of the n-butanol produced. The polymer was aminolyzed to the extent of about 25 mole percent. The polymer was purified by dissolving in tetrahydrofuran and then 10% HCl was added. The liquid phase was decanted from the gummy polymer. This procedure was repeated twice, followed by a fourth and fifth wash using 5% methanolic HCl. The polymer was taken up in tetrahydrofuran and precipitated by dropwise addition with rapid stirring to 10% HCl. After homogenization in a blender and filtration, the process was repeated. The polymer in tetrahydrofuran solution was then precipitated in like manner from deionized water, and this process repeated. After a final precipitation from methanol, the polymer was dried in vacuo. Generally, the polymer sample was dissolved in about five times its weight of tetrahydrofuran. Volumes of the precipitating solutions were 6–10 times those of the polymertetrahydrofuran solution.

250 micron steel beads were coated with about 0.28 percent of the polymer by evaporation of solvent tetrahydrofuran from a tumbling mixture of the beads in a solution of the polymer.

A portion of these coated beads, about 60.0 grams, was placed in a 1 inch diameter column and 5 ml. of dimethylaminotrimethylsilane was passed over the beads on a stream of dry nitrogen over a 90 minute period.

After drying in vacuo for about 17 hours, in a cascade triboelectric measurement under substantially the same conditions as in Example I, the silylated coated carrier beads were found to acquire a net charge of about +0.19 nano-coulombs per gram versus a film of a styrene-n-butyl methacrylate copolymer having a 2.54:1.00 mole ratio. Unsilylated carrier beads coated with the aminolyzed polymer acquired a net charge of about +0.94 nano-coulombs per gram. The carrier bead coating upon silylation was found to have a lower capacity for positive triboelectric charging.

Although specific components, proportions and procedures have been stated in the above description of the preferred embodiments of the novel toner compositions, other suitable components, proportions and procedures a listed above may be used with similar results. Further, other materials and procedures may be employed to synergize, enhance or otherwise modify the novel system.

Other modifications and ramifications of the present invention will appear to those skilled in the art upon the reading of this disclosure. These are intended to be included within the scope of this invention.

What is claimed is:

1. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of solid carrier particles, said toner particles having an average particle diameter of less than about 30 microns and comprising a colorant and a copolymer selected from the group consisting of styrene-alkylmethacrylate and styrene-alkylacrylate wherein said copolymer has been modified to contain active hydrogen containing constituents and then exposed to silylation to provide toner particles characterized as having controlled and optimum triboelectric charging properties between said toner particles and said carrier particles whereby at least a portion of said finely-divided toner particles are attracted to and deposited on said recording surface in conformance with said electrostatic latent image.

2. An electrostatographic imaging process in accordance with claim 1 wherein said copolymer is a vinyl resin having a melting point of at least about 110° F.

3. An electrostatographic imaging process in accordance with claim 2 wherein said vinyl resin has a weight average molecular weight between about 3,000 to about 500,000.

4. An electrostatographic imaging process in accordance with claim 1 wherein said toner particles have a blocking temperature of at least about 110° F and a melt viscosity of less than about $2.5 \times 10^{-4}$ poise at temperature of up to about 450° F.

5. An electrostatographic imaging process in accordance with claim 1 wherein said colorant is present in said toner particles in an amount of from about 1 percent to about 20 percent by weight based on the weight of said toner particles.

6. An electrostatographic imaging process in accordance with claim 1 wherein said colorant is selected from the group consisting of pigments and dyes.

7. An electrostatographic imaging in process in accordance with claim 1 wherein said copolymer has been exposed to controlled stoichiometric silylation so as to provide closely controlled triboelectric properties to said toner particles.

8. An electrostatographic imaging process in accordance with claim 1 wherein said copolymer has been exposed to controlled kinetic silylation so as to provide closely controlled triboelectric properties to said toner particles.

9. An electrostatographic imaging process in accordance with claim 1 wherein said copolymer has been exposed to silylation with at least one silylating agent selected from the group consisting of dimethylaminotrimethylsilane, dimethylchlorosilane, trimethylchlorosilane, and polysiloxanes with reactive terminal moieties.

10. An electrostatographic imaging process in accordance with claim 9 wherein said silylating agent is difunctional and said copolymer is thereby crosslinked.

11. An electrostatographic imaging process in accordance with claim 1 wherein said active hydrogen constituents are aliphatic hydroxyl groups.

12. An electrostatographic developer composition comprising finely-divided toner particles electrostatically clinging to the surface of solid carrier particles, said toner particles having an average particle diameter of less than about 30 microns, said toner particles comprising a colorant and a copolymer selected from the group consisting of styrenealkylmethacrylate and styrene-alkylacrylate wherein said copolymer has been modified to contain active hydrogen constituents and then exposed to silylation to provide toner particles characterized as having controlled and optimum triboelectric charging properties between said toner particles and said carrier particles.

13. An electrostatographic developer composition in accordance with claim 12 wherein said copolymer is a vinyl resin having a melting point of at least about 110° F.

14. An electrostatographic developer composition in accordance with claim 13 wherein said vinyl resin has a weight average molecular weight between about 3,000 to about 500,000.

15. An electrostatographic developer composition in accordance with claim 12 wherein said toner particles have a blocking temperature of at least about 110° F and a melt viscosity of less than about $2.5 \times 10^{-4}$ poise at temperatures of up to about 450° F.

16. An electrostatographic developer composition in accordance with claim 12 wherein said colorant is present in said toner particles in an amount of from about 1 percent to about 20 percent by weight based on the weight of said toner particles.

17. An electrostatographic developer composition in accordance with claim 12 wherein said colorant is selected from the group consisting of pigments and dyes.

18. An electrostatographic developer composition in accordance with claim 12 wherein said copolymer has been exposed to controlled stoichiometric silylation so as to provide closely controlled triboelectric properties to said toner particles.

19. An electrostatographic developer composition in accordance with claim 12 wherein said copolymer has been exposed to controlled kinetic silylation so as to provide closely controlled triboelectric properties to said toner particles.

20. An electrostatographic developer composition in accordance with claim 12 wherein said copolymer has been exposed to silylation with at least one silylating agent selected from the group consisting of dimethylaminotrimethylsilane, dimethylchlorisilane, trimethylchlorosilane, an polysiloxanes with reactive terminal moieties.

21. An electrostatographic developer composition in accordance with claim 20 wherein said silylating agent is difunctional and said copolymer is thereby crosslinked.

22. An electrostatographic developer composition in accordance with claim 12 wherein said active hydrogen constituents are aliphatic hydroxyl groups.

* * * * *